US005307134A

United States Patent [19]

Nakajima et al.

[11] Patent Number: 5,307,134

[45] Date of Patent: Apr. 26, 1994

[54] ELECTROPHOTOGRAPHIC APPARATUS

[75] Inventors: Shigeki Nakajima; Koji Morimoto, both of Tokyo, Japan

[73] Assignee: Oki Electric Industry Co., Ltd., Tokyo, Japan

[21] Appl. No.: 977,050

[22] Filed: Nov. 16, 1992

[30] Foreign Application Priority Data

Nov. 21, 1991 [JP] Japan ..... 3-305776

[51] Int. Cl.[5] ..... G03G 15/20

[52] U.S. Cl. ..... 355/285; 219/216; 355/204; 355/208; 355/289; 355/290

[58] Field of Search ..... 355/282, 285, 289, 290, 355/295, 203, 204, 208; 219/216

[56] References Cited

U.S. PATENT DOCUMENTS

| | | | |
|---|---|---|---|
| 4,349,269 | 9/1982 | Okada | 355/285 |
| 4,373,801 | 2/1983 | Itoh | 355/285 |
| 4,603,245 | 7/1986 | Yagasaki | 219/216 |
| 4,719,489 | 1/1988 | Ohkubo et al. | 355/290 |
| 4,998,121 | 3/1991 | Koh et al. | 346/160 |
| 5,012,286 | 4/1991 | Kawano et al. | 355/208 X |
| 5,164,570 | 11/1992 | Okimura | 219/216 |

FOREIGN PATENT DOCUMENTS 0169876 9/1985 Japan .

*Primary Examiner*—Matthew S. Smith

*Attorney, Agent, or Firm*—Spencer, Frank & Schneider

[57] ABSTRACT

An electrophotographic apparatus for providing a thermally fixed toner image on a recording medium and wherein the fixing temperature can be selectively canceled. The apparatus is of the type including: an image forming unit for forming a toner image to be printed and for then transferring the toner image onto a recording medium, a feed mechanism for feeding a recording medium supplied via one of at least two guide paths to the image forming unit, a fixing unit for thermally fixing the transferred toner image on the recording medium, and a temperature control unit for setting a fixing temperature for the fixing unit. A controller is provided to determine the particular guide paths used to supply the recording medium and to command the temperature control unit to set a fixing temperature in accordance with the determined guide path. Preferably, one of the guide path is supplied by a sheet feeder and the other guide path is a horizontal path permitting manual insertion, and the controller causes a lower fixing temperature to be set when the recording medium is supplied by the feeder and a higher fixing temperature when the recording mechanism is supplied via the horizontal guide path.

8 Claims, 3 Drawing Sheets

ELECTROPHOTOGRAPHIC APPARATUS

REFERENCE TO RELATED APPLICATIONS

This application claims the priority of Japanese application Ser. No. 305776/1991 filed Nov. 21st, 1991, which is incorporated herein by reference.

BACKGROUND OF THE INVENTION

1. Field of the Invention

This invention relates to an electrophotographic apparatus of the type where toner is thermally fixed on a recording medium, and especially to an electrophotographic apparatus permitting fail-free fixing irrespective of the type of recording medium.

An electrophotographic apparatus is equipped with a cylindrical photoreceptor, a primary charger for charging a surface of the photoreceptor, an exposure light source for forming a latent electrostatic image on the photoreceptor, a developing device for applying toner to the latent electrostatic image to develop the same, a transfer charger for electrostatically attracting the toner from the photoreceptor to a recording medium so as to achieve transfer of the toner, a cleaning device for removing any toner still remaining on the surface of the photoreceptor, a fixing unit for fixing the toner image on the recording medium, and a feed mechanism for feeding the recording medium.

The primary charger charges the surface of the photoreceptor to impart photosensitivity to the surface. Next, the exposure light source illuminates the photoreceptor to form a latent electrostatic image on the surface of the photoreceptor. The developing device then applies toner in accordance with the latent electrostatic image on the surface of the photoreceptor so that a toner image is formed. Subsequently, the toner image is transferred onto the recording medium by the transfer charger.

Recording media, such as normal paper sheets, stored in a paper supply tray are fed out one by one from the tray along a usually curved guide path in accordance with rotation of the feed roller and are then delivered to the transfer charger in synchronization with rotation of the photoreceptor. After the toner image has been transferred at the transfer charger, the recording medium is subjected to thermal fixing at the fixing unit so that the toner image is fixed on the recording medium.

On the other hand, special media such as envelops or postcards are each conveyed horizontally to the transfer charger via a guide path or route into which such special media are manually inserted. These special media are therefore conveyed without bending. Each special medium with a toner image likewise transferred thereon by the transfer charge, is fed to the fixing unit, where thermal fixing is conducted similarly.

The above-described electrophotographic apparatus permits printing on a wide variety of media, including recording media, such as general paper, and special media such as envelops and postcards. However, for this purpose, the fixing unit normally must be set at a fixing temperature sufficiently high to fix toner images on various media without failure. Namely, its fixing temperature must be set at a level sufficiently high so that fixing is feasible even on recording media having a large thickness and poor fixation such as envelops and postcards.

Fixing is therefore always performed at the high temperature set in view of media having poor fixation properties despite that fixing can be conducted at a lower temperature when general or normal paper is being printed. Accordingly, when a general recording medium such as normal paper is being used, electricity is wasted and, moreover, curling of the recording media occurs.

SUMMARY OF THE INVENTION

An object of this invention is to provide an electrophotographic apparatus which can achieve thermal fixing of a toner image on a recording medium without wasting electricity or causing curling on the recording medium.

Another object of this invention is to provide an electrophotographic apparatus which can print both recording media such as general paper and special media such as envelopes and postcards and can perform thermal fixing at temperatures suited for the former and latter recording media, respectively.

A further object of this invention is to provide an electrophotographic apparatus which can selectively set the fixing temperature depending on the feed path of a recording medium.

The above object generally is achieved according to the present invention by an electrophotographic apparatus which comprises:

an image forming unit for forming a toner image to be printed and for then transferring the toner image onto a recording medium; a feed mechanism for feeding a recording medium supplied via one of at last two guide paths to the image forming unit; a fixing unit for thermally fixing the transferred toner image on the recording medium; a temperature control unit for setting a fixing temperature for the fixing unit; and a controller for determining the one of the guide paths along which the recording medium has been supplied and for commanding the temperature control unit to set a fixing temperature in accordance with the determined guide path.

According to a preferred feature of the invention, the controller commands the temperature control unit to set a different fixing temperature for each respective guide path.

According to the features of the preferred embodiment, the feed mechanism comprises: a feed roller for feeding recording media from a supply tray; means, controlled by the controller, for driving the feed roller; a first guide path for guiding the recording media supplied by the feed roller; a second guide path disposed horizontally and formed to permit manual insertion of a recording medium; and a sensor for detecting the presence of a recording medium along any of the first and second guide paths and for supplying a corresponding output signal to the controller. With this preferred embodiment, the controller determines the guide path along which the recording medium has been supplied from the output signal from the sensor and the driven state of the feed roller, and preferably commands setting of a lower fixing temperature when the recording medium has been supplied along the first guide path and commands setting of a higher fixing temperature when the recording medium has been supplied along the second guide path.

Desirably the electrographic apparatus further comprises at least two discharge paths for discharge of the fixed recording medium from the fixing unit; and a change-over mechanism, controlled by the controller, for selectively directing a fixed recording medium to one of the discharge paths. Preferably the controller controls the change-over mechanism to select one of the discharge paths on the basis of the determination of the guide path used to supply the recording medium.

According to the present invention, the fixing temperature of the fixing device is set depending on the guide path or route of the recording medium, which generally corresponds to the thickness of the recording medium. Where the recording medium is a thick special medium, the fixing is conducted at a high temperature so that the fixing can be achieved under good conditions. Where the recording medium is a general paper sheet whose thickness is not great, the fixing is conducted at a low temperature so that the fixing is not effected at unnecessarily high temperatures. This has made it possible to avoid or at least minimize such problems as the occurrence of paper curling at high temperatures and the wasting of electric power.

DETAILED DESCRIPTION OF THE PREFERRED EMBODIMENT

One embodiment of the present invention will hereinafter be described with reference to the accompanying drawings.

Figure 1:
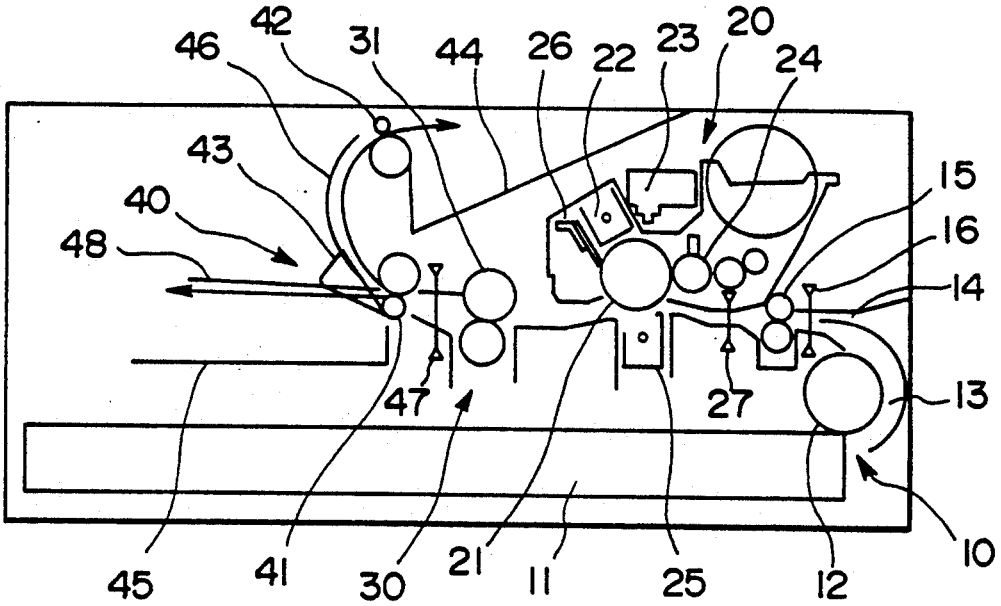
FIG. 1 is a simplified, schematic, sectional view of an electrophotographic apparatus according to one embodiment of this invention.

In FIG. 1, the electrophotographic apparatus comprises a feed mechanism 10 for feeding a recording medium such as a general paper sheet or a special medium such as an envelope or postcard, an image forming unit 20 for forming a toner image and transferring it onto the recording medium, a fixing unit 30 for fixing the toner image on the recording medium, and a discharge mechanism 40 for discharging the recording medium subsequent to the completion of the fixing.

The feed mechanism 10 has a paper tray 11, a feed roller 12, a guide path or route 13, a further guide path or route 14, a register roller 15, and an inlet sensor 16.

The paper tray 11 is designed to store a plurality of recording media such as general paper sheets. The recording media stored in the paper tray 11 are engaged one after another by rotation of the feed roller 12 and are fed out along the curved guide path or route 13. The guide path or route 14, on the other hand, is constructed to permit horizontal insertion of special media such as envelopes or postcards, whereby the special media can be fed without being bent.

Each recording medium which has been fed along either one of the guide paths 13 or 14 is delivered to the nip of a pair of register rollers 15 and is then transported to the image forming unit 20 due to rotation of the register rollers 15. The outer surface of one of the rollers 15 is formed of a frictional material such as rubber, whereas the outer surface of the other roller 15 is made of a material having a low coefficient of friction such as a metal or plastic. In a known manner, the feed roller 12 and the register rollers 15 are coupled to a common paper feed motor, e.g. by respective centrifugal clutches, so that only the feed roller 12 rotates when the common paper feed motor rotates in a first normal direction, and only the register rollers 15 rotate when the common paper feed motor rotates in the reverse direction.

The inlet sensor 16 is arranged immediately before the register rollers 15 to detect the presence of the recording medium at that location. A photosensor is used as the inlet sensor 16. The recording medium transported to the location of the inlet senso 16 directly cuts off an optical axis so that the presence of the recording medium is detected.

The image forming unit 20, which serves to form a toner image, is constructed of a cylindrical photoreceptor 21, a primary charger 22, an exposure light source 23, a developing device 24, a transfer charger 25, a cleaning device 26, and a writing sensor 27.

The cylindrical photoreceptor 21 is rotated by a photoreceptor drive motor to be described subsequently. The primary charger 22 charges a surface of the photoreceptor 21 to impart photosensitivity. The exposure light source 23 directs light onto the surface of the photoreceptor 21 so that a latent electrostatic image is formed on the surface of the photoreceptor 21. The developing device 24 applies toner, which is charged with an opposite polarity to the latent electrostatic image, to the surface of the photoreceptor 21 to form a toner image. The transfer charger 25 applies charges, which are opposite to those of the toner image, to the recording medium from the back side thereof, so that the toner on the photoreceptor 21 is attracted onto the recording medium to achieve the transfer of the toner image. The cleaning device 26 removes any toner which still remains on the surface of the photoreceptor 21 after the transfer.

The above series of operations are successively performed as the photoreceptor 21 rotates in a known manner. The writing sensor 27 comprises a photosensor and detects the recording medium fed by the register rollers 15. The operation of the image forming unit 20 is initiated using the detection of the recording medium by the writing sensor 27 as a trigger.

The fixing unit 30 generally includes a fixing device 31 to be described subsequently. When the recording medium with the toner image transferred thereon passes through the fixing device 31, both heat and pressure are applied to the toner image so that the toner image is fixed on the recording medium.

The discharge mechanism 40 is constructed of discharge rollers 41,42, a separator 43, receptacles 44,45, discharge paths or routes 46,48 and a discharge sensor 47.

The discharge sensor 47 is arranged immediately after the fixing unit 30. A discharging operation is conducted based on the detection of the recording medium by the discharge sensor 47. As the discharge roller 41 rotates, the recording medium, such as the general paper sheet, is fed and then transported along the upwardly curved discharge path or route 46. Via the discharge roller 42, the recording medium is finally discharged onto the receptacle or tray 44. On the other hand, the traveling direction of the special medium, such as the envelope or postcard, is changed by the separator 43 and is then discharged into the receptacle or tray 45 along the straight discharge path or route 48.

Figure 2:
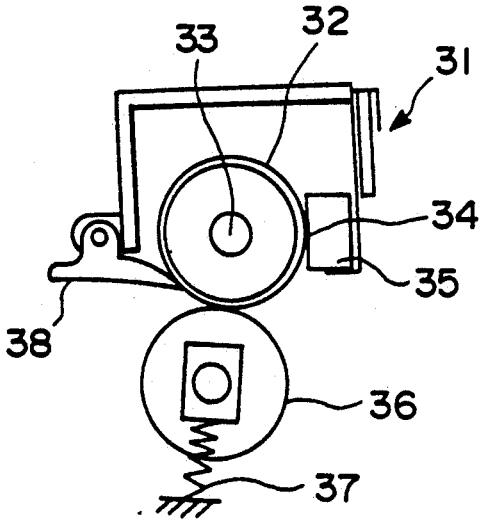
FIG. 2 is a schematic, cross-sectional view of a fixing device in the electrophotographic apparatus of FIG. 1.

The fixing device 31 will be described with reference to FIG. 2. The fixing device 31 is constructed of a heat roller 32, a heat source 33, a temperature sensor 34, preferably a thermistor, a sensor (thermistor) holder 35, a rubber roller 36, a compression coil spring 37, and stripping fingers 38.

The heat roller 32 is formed of an aluminum hollow pipe as a base and is surface-coated with a fluoroplastic to prevent sticking of toner on its surface. Halogen lamps or the like, preferably disposed within the hollow heat roller 32, are used as the heat source 33 so that the heat roller 32 can be heated. The temperature sensor 34 is maintained in close contact with the surface of the heat roller 32 by the sensor holder 35 for the purpose of controlling the surface temperature of the heat roller 32. Namely, the heat source 33 is turned on or off in accordance with the resistance of the temperature sensor 34 as a reference value so that the surface temperature of the heat roller 32 is maintained at a preset temperature.

The rubber roller 36 is made of a material having high heat resistance such as silicone, and is provided and mounted so that the recording medium is pressed against the surface of the heat roller 32 under the spring force of the compression coil spring 37. The stripping fingers 38 are disposed so that their free ends are maintained in contact with the surface of the heat roller 32. The stripping fingers 38 separate the recording medium subsequent to its fixing so that the recording medium is prevented from winding around the heat roller 32.

Figure 3:
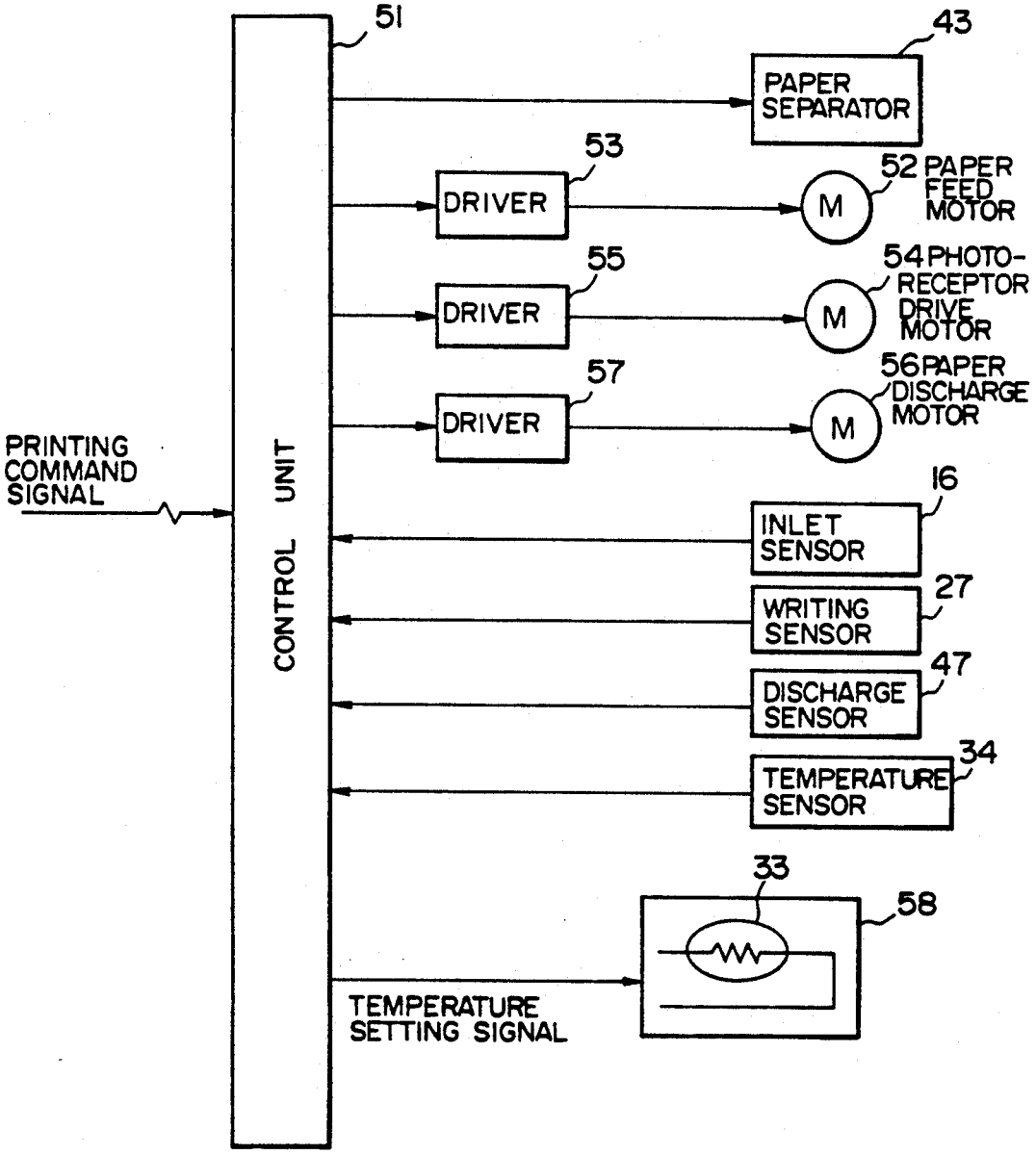
FIG. 3 is a block diagram of a control system for the electrophotographic apparatus of FIG. 1.

The control system of the electrophotographic apparatus will now be described with reference to FIG. 3. A control unit 51 controls paper feeding, image formation, fixing, discharge, etc. in the electrophotographic apparatus. Connected to, and controlled by, the control unit 51 are a driver 53 for driving a paper feed motor 52 for the feed roller 12 and the register rollers 15, a driver 55 for driving a photoreceptor drive motor 54, for the photoreceptor 21, and a driver 57 for driving a paper discharge motor 56 for the discharge rollers 41 and 42.

In response to a signal from the inlet sensor 16, the control unit 51 controls the driver 53 to reverse the direction of rotation of the paper feed motor 52 from a normal direction, wherein the feed roller 12 is driven, to the reverse direction, wherein the register rollers 15 are driven (see FIG. 1). The control unit 51 also controls the driver 55 in accordance with a signal from the writing sensor 27, whereby the photoreceptor drive motor 54 is driven to rotate the cylindrical photoreceptor 21. The control unit 51 further controls the driver 57 in accordance with a signal from the discharge sensor 47 to drive the discharge motor 56, so that the discharge rollers 41,42 (see FIG. 1) are rotated.

The paper separator 43 is actuated under the control of the control unit 51 so that the direction of discharge of the recording medium is changed over at the proper time.

Also connected to the control unit 51 are the temperature sensor 34 and a temperature control unit 58. The control unit 51 controls the temperature control unit 58 on the basis of an output from the temperature sensor 34 to control the temperature of the fixing device 31 and in particular the heat source 33.

The operation of the electrophotographic apparatus will now be described based on the construction depicted in FIGS. 1-3.

Upon reception of a print command signal via an unillustrated interface, and if the inlet sensor 16 is not indicating the presence of a recording medium, the control unit 51 actuates the driver 53 so that the paper feed motor 52 begins to rotate and in turn causes the feed roller 12 to be rotated in a feed direction. This rotation of the feed roller 12 results in the recording media, such as general paper sheets, stored in the paper tray 11 to be fed out one by one. Each recording medium fed out from the paper tray 11 is guided along the guide path or route 13 to the nip of the pair of register rollers 15, which are not rotating at this time.

The fed-in distance of the recording medium is controlled in accordance with an ON signal, i.e. a signal representing detection, from the inlet sensor 16. Subsequent to receipt of the signal from the inlet sensor 16 indicating the detection of the recording medium, the control unit 51 controls the paper feed motor 52 so that the recording medium can be fed only over a predetermined distance (which is equal to the distance between the inlet sensor 16 and the register rollers 15 plus several millimeters). After the leading edge of the recording medium has reached the nip of the register rollers 15, the recording medium is thereafter fed over several additional millimeters so that any oblique running (skew) of the recording medium is corrected at the nip of the register rollers 15.

The control unit 51 next, via the driver 53, reverses the direction of rotation of the paper feed motor 52 and thus to rotate the register rollers 15 in the feed direction. When the recording medium fed as a result of the rotation of the register rollers 15 has reached the writing sensor 27, the resulting ON, i.e., detection, signal from the writing sensor 27 initiates a n image forming process in the image forming unit 20, and causes the control unit 51 to momentarily stop or otherwise control the rotation of the register rollers 15 so as to synchronize the feeding of the recording medium with the image forming process.

For the image forming process, the photoreceptor 21, which has been uniformly charged by the primary charger 22, is rotated by the photoreceptor motor 54 via the driver 55 under control of the control unit 51, and a latent electrostatic image is formed on the photoreceptor 21 by the exposure light source 23. The latent electrostatic image is then made visible as a toner image by the developing device 24.

Further rotation of the photoreceptor 21 causes the thus formed toner image to move to the transfer charger 25. During this time, the recording medium is being transported by the register rollers 1 in synchronization with the rotation of the photoreceptor 21. The toner image is therefore transferred onto a predetermined area of the recording medium by the transfer charger 25. After the transfer, any toner still remaining on the surface of the photoreceptor 21 is scraped off by the cleaning device 26.

After the completion of the imaging, the recording medium is transported to the fixing unit 30 and is caused to pass between the heat roller 32 and the rubber roller 36 in the fixing device 31. At this time, both heat and pressure are applied to the toner image on the recording medium so that the toner image is fixed on the recording medium.

Responsive to a signal from the discharge sensor 47, the control unit 51 actuates the driver 57 to rotate the paper discharge motor 56. As a result, the discharge rollers 41,42 rotate, so that the thus fixed recording medium is fed out along the discharge route 46 and is then discharged into the receptacle 44.

When a special medium having a large thickness such as an envelop or postcard is to be printed, it is difficult to feed the thick special medium along the guide path or route 13 which is provided in a lower part of a main body of the electrophotographic apparatus to reduce the area occupied by the apparatus, and which is formed in a U-shape having a small radius of curvature. The operator therefore manually inserts the special medium along the straight generally horizontal guide path 14.

Thereafter, the control unit 51, in response to a print command signal input via an unillustrated interface and detection of the insertion of the special medium on the basis of a signal from the inlet sensor 16, actuates the driver 53 to rotate the paper feed motor 52 in the proper direction to cause the register rollers 15 to rotate and feed the special medium to the image forming unit 20. As in the feeding of the recording medium from the paper tray 11 the feeding of the special medium by the register rollers 15 is controlled by the control unit 51 to synchronize its feeding with the image forming process in the imaging device 20.

Irrespective of whether the recording medium is fed in via the path 13 or the path 14, upon receipt of an ON signal from the inlet sensor 16, the control unit 51 also checks to determine if the paper feed motor 52 is being driven at that time. If the check indicates that the paper feed motor 52 is not being driven, the control unit 51 determines that the recording medium has been fed along the guide path 14, which in general means that a special recording medium has been fed into the apparatus.

It is therefore unnecessary to provide any special sensor for distinguishing between different types of recording media. Only a signal from the inlet sensor 16 provided commonly for the two guide paths 13,14 is necessary for the control unit 51 to determine along which one of the guide paths 13,14 a recording medium has been fed, or in other words, whether a general or normal paper sheet or a special medium has been fed into the apparatus. This determination of the particular guide path 13 or 14 used for feeding of the recording medium is used by the control unit 51 to control the fixing temperature in the fixing unit 30.

Thermal fixing of toner is carried out by fusing the toner transferred onto a surface of a recording medium and then raising the temperature of the recording medium to have the thus-fused toner penetrate into the recording medium. Fixing is therefore feasible at a low temperature where the thickness of the recording medium is not great, e.g. a general or normal paper sheet. However, in the case of a special medium having a large thickness, it is necessary to raise the fixing temperature so that the temperature of the recording medium can be increased. Accordingly, based on the determination that the recording medium has been fed in via the path 14, and thus that a special medium has been supplied, the control unit 51 sends a high-temperature setting signal to the temperature control unit 58.

In response to the high-temperature setting signal, the temperature control unit 58 actuates the heat source 33 of the fixing device 31 to produce high heat so that the heat roller 32 is maintained at a high temperature suitable for special recording media, e.g. the high temperature used according to the prior art. Temperature control at this time is effected in a known manner based on the detection of the temperature by the temperature sensor 34. Alternatively, if the control unit 51 determines that the recording medium has been supplied via the guide path 13, then the control unit 51 controls the temperature control unit 58 to provide a low temperature suitable for fixing general (normal) printing paper.

If the control unit 51 determines that the high fixing temperature is to be used, i.e. the insertion of a recording medium via the guide path 14, the control unit 51 also changes or switches the position of the paper separator 43. As a consequence, the special medium is discharged horizontally into the receptacle 45 along the discharge path or route 48 instead of following the U-shaped discharge route 46.

Figure 4:
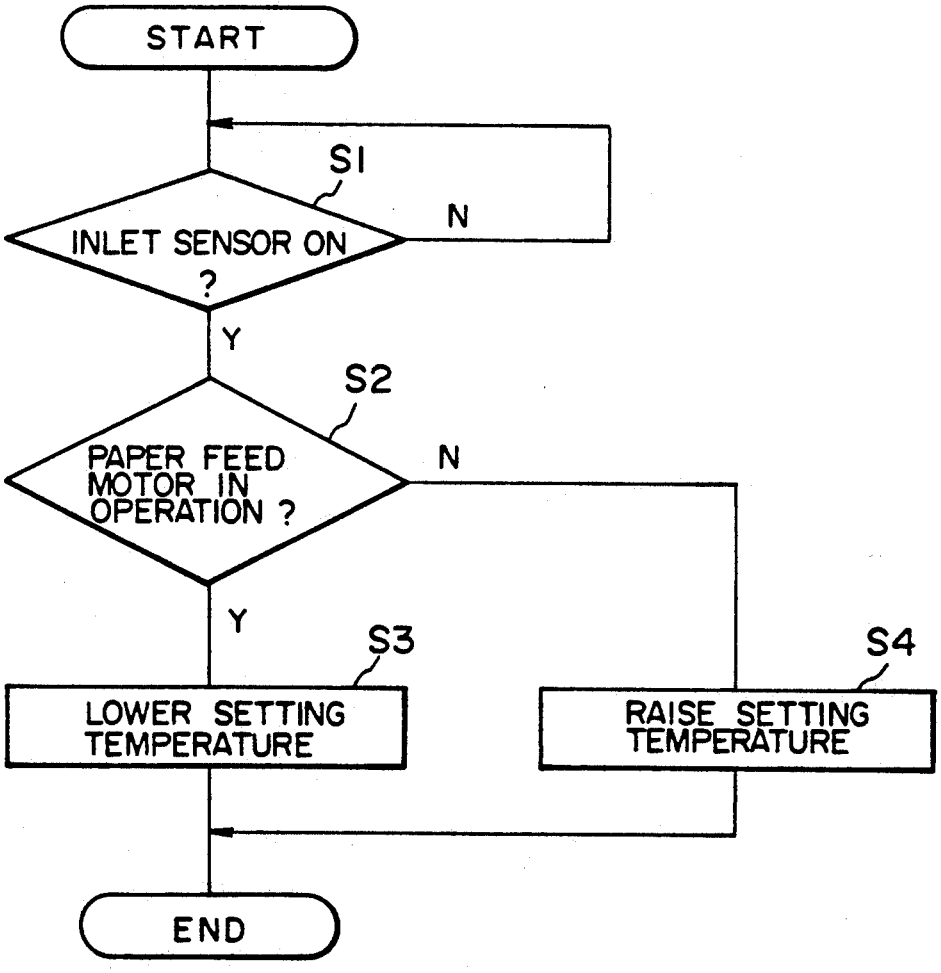
FIG. 4 is a flowchart of a fixing temperature setting operation in the electrophotographic apparatus of FIG. 1.

A fixing temperature setting operation in the electrophotographic apparatus according to the present invention will be described with reference to the flowchart depicted in FIG. 4.

In a first step S1, the control unit 51 determines whether or not the inlet sensor 16 has been turned on. If the inlet sensor 16 has not been turned on yet, the routine remains there until the inlet sensor 16 is turned on by detection of a recording medium.

If the inlet sensor 16 has been turned on, then in the next step S2, and upon receipt of an ON signal from the inlet sensor 16, the control unit 51 determines whether or not the paper feed motor 52 is in operation (being driven) at that time, e.g. driving the feed roller 12.

If the paper feed motor 52 is determined to be in operation, the control unit 51 sends a low-temperature setting signal to the temperature control unit 58 so that the fixing device 31 can be set at a low fixing temperature (step S3).

If the paper feed motor 52 is determined not to be in operation when the ON signal from the sensor 16 is received, the control unit 51 delivers a high-temperature setting signal to the temperature control unit 58 to set the fixing device 31 at a high fixing temperature (Step S4).

The invention now being fully described, it will be apparent to one of ordinary skill in the art that any changes and modifications can be made thereto without departing from the spirit or scope of the invention as set forth herein.

We claim:

1. An electrophotographic apparatus for providing a thermally fixed toner image on a recording medium, comprising:

an image forming unit for forming a toner image to be printed and for then transferring the toner image onto a recording medium;

a feed mechanism for feeding a recording medium supplied via one of at least a first guide path and a second guide path to said image forming unit, said feed mechanism having a feed roller for supplying recording media to said first guide path from a supply tray, and means for driving said feed roller;

a sensor disposed between said image forming unit and said first and second guide paths for detecting the presence of a recording medium supplied via either of said first and second guide paths and for producing a corresponding output signal;

a fixing unit for thermally fixing the transferred toner image on the recording medium;

a temperature control unit for setting a fixing temperature for said fixing unit; and a controller for controlling said driving means to drive said feed roller, for determining the one of said first and second guide paths along which the recording medium was supplied in accordance with a combination of the output signal from said sensor and a driven state of said feed roller, and for commanding the temperature control unit to set a fixing temperature in accordance with the determined guide path.

2. The apparatus of claim 1, wherein said controller commands said temperature control unit to set a different fixing temperature for each respective guide path.

3. The apparatus of claim 1, wherein said second guide path is disposed horizontally and is formed to permit manual insertion of a recording medium.

4. The apparatus of claim 3, wherein said controller determines that the recording medium was supplied along said first guide path when the controller receives the output signal from the sensor indicating the presence of a recording medium and when the feed roller is being driven, and that the recording medium was supplied along said second guide path when the controller receives the output signal indicating the presence of a recording medium and when the feed roller is not being driven.

5. The apparatus of claim 4, wherein the controller commands setting of a lower fixing temperature when the recording medium is determined to have been supplied along the first guide path and commands setting of a higher fixing temperature when the recording medium is determined to have been supplied along the second guide path.

6. The apparatus of claim 4, further comprising:

at least two discharge paths for discharge of a fixed recording medium from said fixing unit; and a change-over mechanism, controlled by said controller, for selectively directing a fixed recording medium to one of said discharge paths.

7. The apparatus of claim 6, wherein said controller controls the said change-over mechanism to select one of said discharge paths on the basis of the determination of the guide path along which the recording medium has been supplied.

8. The apparatus of claim 7, wherein one of said discharge paths is formed to permit horizontal discharge of the fixed recording medium; and wherein said controller control said change-over mechanism to select the discharge path for horizontal discharge of the fixed recording medium when the recording medium has been determined to be supplied along the second said guide path.

* * * * *